US009133598B2

(12) United States Patent
Hsu

(10) Patent No.: US 9,133,598 B2
(45) Date of Patent: Sep. 15, 2015

(54) SEALED INTERCONNECTED MAT SYSTEM

(71) Applicant: Tim T. Hsu, State College, PA (US)

(72) Inventor: Tim T. Hsu, State College, PA (US)

(73) Assignee: Polymics, Ltd., State College, PA (US)

( * ) Notice: Subject to any disclaimer, the term of this patent is extended or adjusted under 35 U.S.C. 154(b) by 10 days.

(21) Appl. No.: 14/157,520

(22) Filed: Jan. 17, 2014

(65) Prior Publication Data

US 2014/0196799 A1 Jul. 17, 2014

(51) Int. Cl.
*E02D 31/00* (2006.01)

(52) U.S. Cl.
CPC ..... *E02D 31/002* (2013.01); *Y10T 137/5762* (2015.04)

(58) Field of Classification Search
USPC ..... 404/35, 40, 68
IPC ..... E01C 5/003,5/005, 5/006
See application file for complete search history.

(56) References Cited

U.S. PATENT DOCUMENTS 3,030,703 A * 4/1962 Wirsing, Jr. ..... 228/181
3,231,289 A 1/1966 Carrell
3,348,459 A 10/1967 Harvey
3,602,110 A * 8/1971 Wiggins ..... 404/40
3,614,915 A * 10/1971 Perry ..... 404/40
3,635,130 A * 1/1972 Perry ..... 404/40
3,712,187 A * 1/1973 Stelling ..... 404/3
4,065,902 A 1/1978 Lindal
4,650,180 A * 3/1987 Blondel ..... 472/92
4,717,036 A 1/1988 Dundas et al.
4,786,088 A 11/1988 Ziu
4,809,866 A 3/1989 Crocker
4,832,999 A * 5/1989 Sweet ..... 428/116
4,850,093 A * 7/1989 Parente ..... 29/428
5,002,402 A 3/1991 Parvin
5,010,690 A 4/1991 Geoffrey
5,051,020 A 9/1991 Schleicher
5,149,226 A 9/1992 Antinoro et al.
5,964,549 A * 10/1999 Frantzen ..... 404/44
6,233,886 B1 * 5/2001 Andres ..... 52/177
6,652,183 B2 11/2003 Stasiewich et al.
6,695,527 B2 2/2004 Seaux et al.
6,746,176 B2 6/2004 Smith
7,322,747 B2 1/2008 Borchardt
7,415,801 B2 8/2008 Zeng et al.
7,496,992 B2 3/2009 Ausnit
7,691,526 B2 4/2010 Frazier
8,061,929 B2 11/2011 Dagesse
8,062,728 B2 11/2011 De Baets et al.
8,096,728 B2 1/2012 Stasiewich et al.
8,146,317 B1 * 4/2012 Fletcher et al. ..... 52/582.2
2007/0250025 A1 10/2007 Sams et al.
2009/0142542 A1 6/2009 Halahmi et al.
2011/0299923 A1 12/2011 Bleile et al.

* cited by examiner

*Primary Examiner* — Gary Hartmann
(74) *Attorney, Agent, or Firm* — Vinnovations Law, PLLC

(57) ABSTRACT

A sealed mat system that protects an environment from discharge of a fluid or a solid material is disclosed. The mat system comprises interconnected channels, seals, and a composite panel structure.

13 Claims, 6 Drawing Sheets

SEALED INTERCONNECTED MAT SYSTEM

RELATED APPLICATIONS

This application claims priority to U.S. Provisional Patent Application No. 61/753,435, filed Jan. 17, 2013.

INTRODUCTION

There are many fluids associated with industrial operations such as those chemicals and liquids used or generated during oil and gas drilling. Fracking liquids generated during fracturing operations can amount to millions of gallons per drill site. These chemicals and liquids need to be contained from accidental spills. Environmental clean-up of these accidentally released materials can be a costly and time consuming endeavor. The release of such materials can also jeopardize the safety of workers at job sites through increased exposure to slip and falls.

Existing systems serve as improvised job site support schemes rather than actual spill containment systems. The existing systems often require a preinstalled disposal liner and a non-sealable layer to be used as a working surface. The liners cost well over $100,000 per installation in addition to the high cost of the non-sealable layer. In spite of their significant costs, the liners are not reusable.

In addition, the useful life of the disposable liners is diminished due to their fragile nature. The liners can be easily torn in the course of normal use and must frequently be repaired or, if badly damaged, discarded prior to final inspection of the work site. After each use, the disposal liners must be land filled, thereby generating substantial solid waste. With respect to their mode of operation, the liners typically utilize socket type end bars into which a coupling bar is inserted. As a consequence of this design mechanism, liners are not leak proof. Fluid is able to penetrate and pass through the end bars and coupling bars of the disposable liners to an adjacent worksite, oil field, ground or watershed. As such, the potential for leaks and harm to the environment is significant.

Further disadvantages of the current liners and collection apparatus relate to their complexity and considerable weight, which is roughly 1000 pounds per 8×14 inches of rigid layer. A forklift is required to transport the liners and related apparatus, at significant expense, since drilling rigs move to different work sites in about a 30-day cycle. As a consequence, the apparatus must frequently be assembled and disassembled by workers. So too, disposable liners must often be replaced, causing undue strain to workers due to the liners' sheer weight and mass. As a result of their unwieldy size and complexity, the liner systems are even more difficult to assemble and disassemble during rainy or cold weather. Deposits of soil, sludge, waste materials, and oil on liner joints and surfaces present similar challenges. Furthermore, locks on the liner systems are complicated and require special tools for deployment and removal. All of these factors increase the risks of operator errors and worker injuries.

Existing liner systems are designed such that sections are connected together in an edge-to-edge fashion utilizing a joint. Each section of the liner system moves independently under load and creates substantial bending or flex load at the joint. The load is not distributed at the joint with existing designs, thereby creating a potential leakage path throughout the apparatus.

Since securing of the liner systems has been ineffectual, efforts have been made to secure the liner apparatus through the use of a secondary liner and/or an elastic surface. Such secondary liners and elastic surfaces are subject to job site wear and tear, which eventually leads to leakage. Furthermore, the liner system does not account for anticipated thermal expansion and shrinkage due to temperature variations at a job site. Temperatures can vary from well below freezing to significantly above 100° F. In addition to the foregoing structural drawbacks, cumulative dimensional changes over a very wide span of liner system installations (e.g. over 100 feet in length and width) also contribute to the inability to ensure proper closure when the liner apparatus is installed.

SUMMARY

The present teachings relate to a sealed mat system that provides a stable and reliable surface for drilling and other technical or vocational operations while protecting an environment from discharge of a fluid or a solid material. The sealed mat system is expandable, rigid, and features an integrated design with interlocking channels that seal against material discharge and drill site fluids under atmospheric pressure. The sealed mat system can be deployed at myriad locations in connection with a variety of uses. By way of example, and not limitation, the sealed mat system can be utilized in environments where an uncontaminated and secure working surface is desired or where capture and containment of a discharged material is desired. Such locations include, but are not limited to, construction sites, chemical storage sites, oil and gas drill sites, on or off-shore oil fields, fracturing sites, factories, disaster sites, recreational areas, and bodies of water. The sealed mat system can also be utilized near down-stream or subsequent processing operations to secure onsite leaks and spills.

The sealed mat system, also referred to herein as the "spill containment system," comprises an integral sealed mat structure that bears the load of oil and gas drilling equipment and onsite vehicles. The sealed mat structure secures and prevents solids and fluids such as water, mud and fracturing products (e.g. sand, chemicals, and hydraulic fluid) discharged thereon from escaping into the environment. The sealed mat system is lightweight and field useable such that it is able to withstand the harsh elements and terrain associated with a job site while also providing a safe working surface for personnel. The upward facing work surface of the sealed mat system can hold chemical and fluid storage tanks, machinery and equipment, and withstand traffic from workers, trucks and other heavy vehicles.

The sealed mat system is reusable and can be easily cleaned for use at multiple job sites. In the case of oil drilling, for example, drilling rigs typically relocate to a different site in about a 30-day cycle. Due to its lightweight design and ease of both assembly and disassembly, the sealed mat system reduces and, in many cases, eliminates personnel strain occasioned by the lifting of heavy equipment. This also eases transportation burdens and costs.

When assembled, the spill containment system provides a rigid unitary design and forms a comprehensive seal (both primary and supplementary) over an installation site. In some embodiments, the spill containment system is assembled by joining multiple interconnected channels having a plurality of internal cell frames or blocks. Each of the cell frames is supported by specially designed connecting or composite panels. The load amongst the composite panels is distributed throughout the entire spill containment system. Furthermore, all the primary seals of the system are under constant compressive loads, thereby preventing breaches of the seals due to flex or bending stress. The internally connected frames move both length-wise and width-wise independently of each composite panel. This design localizes each panel cell, thus minimizing and accommodating expansion and dimensional changes from temperature variations.

The primary and supplementary seals of the present teachings are adaptive and can accommodate movement internally. This is to be contrasted with existing liner systems, in which equipment is tightened or locked at the gasket or other joint. Such locked joints can be breached when subjected to an excessive stress concentration. As described herein, workload is distributed throughout the sealed mat system of the present teachings, and each panel of the mat system expands and moves independently of the other panels in the mat system. In contrast to the localized movement of the present sealed mat system, existing liner systems are connected in an edge-to-edge fashion. In the edge-to-edge arrangement there is cumulative expansion, that is, all the liner apparatus shifts or moves when one section moves. Moreover, existing systems have workload concentrated on each individual section, which is transferred to connecting gaskets. This exerts a high bending stress at the gasket or other joint.

In certain embodiments, the connection pattern of the sealed mat system is extended to further comprise a peripheral embankment or an outer wall. The interlocked and interconnected channel system comprising internal cell frames provides economical, reusable, and leak proof construction of the sealed mat system.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

In the following detailed description, certain specific terminology will be employed for the sake of clarity and particular embodiments will be described. It will be understood that the same is not intended to be limiting and should not be so construed inasmuch as the subject matter described herein is capable of taking many forms and variations within the scope of the appended claims.

Figure 1:
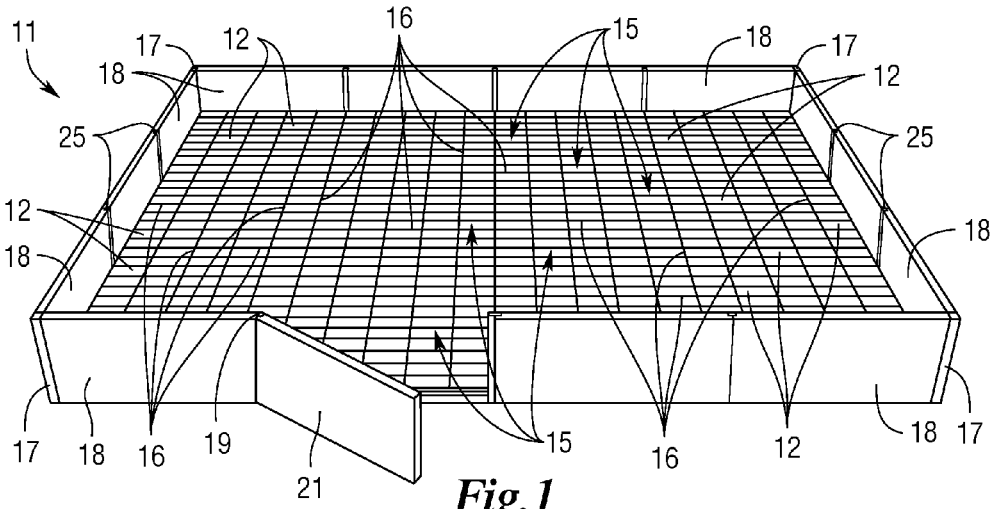
FIG. 1 illustrates an example of a sealed interconnected mat system comprising an optional peripheral wall in accordance with aspects of the subject matter disclosed herein.
Figure 7A:
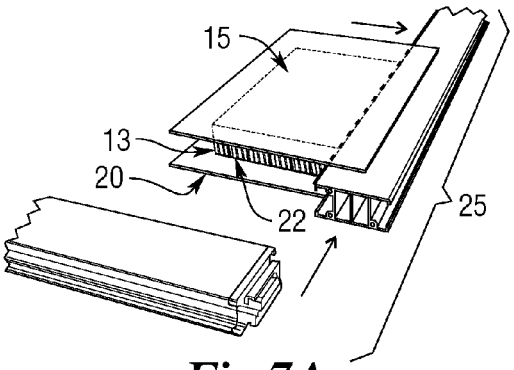
FIGS. 7A-7D illustrate an example of the assembly of a sealed mat system in accordance with an embodiment of the subject matter disclosed herein.
Figure 7B:
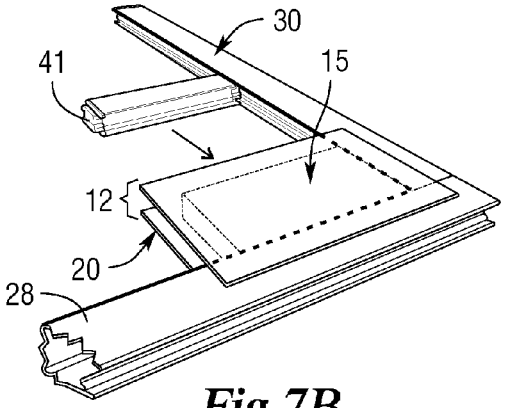
Figure 7C:
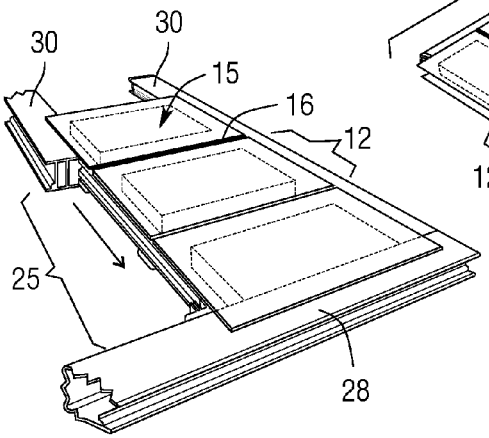
Figure 7D:
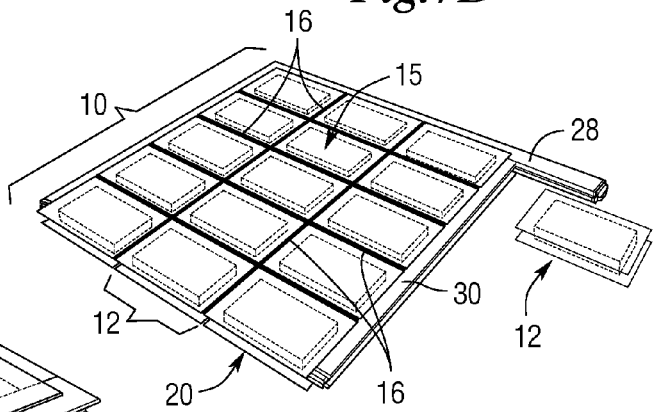
Figure 7E:
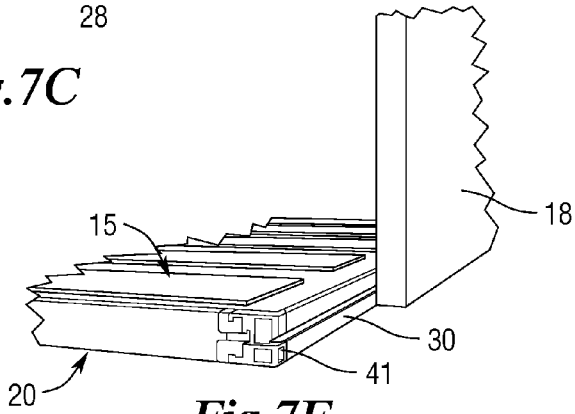
FIG. 7E illustrates an example of a channel end connector as well as a portion of a wall in accordance with aspects of the subject matter disclosed herein.
Figure 8A:
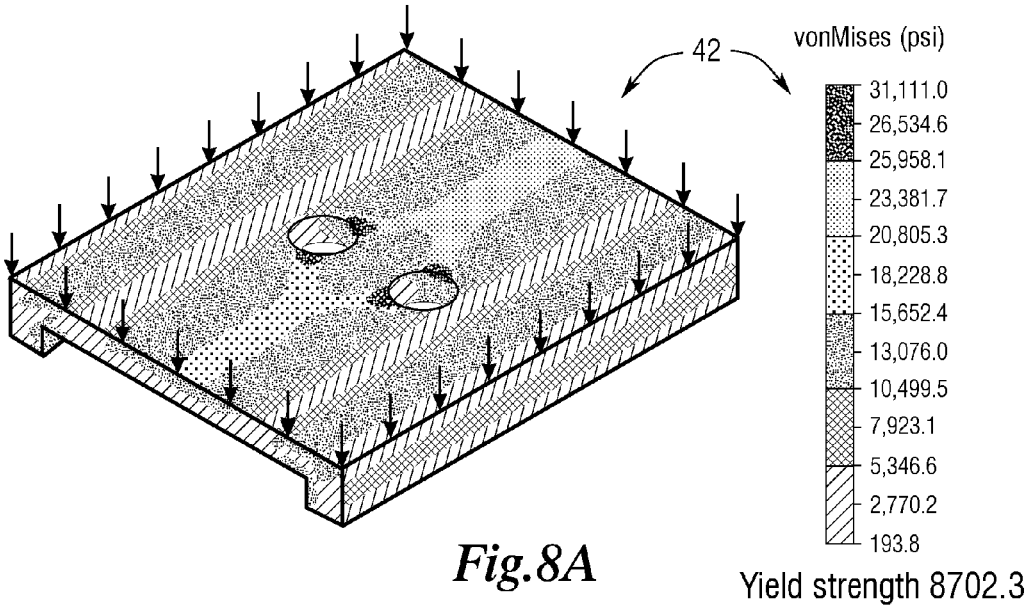
FIGS. 8A, 8B, 8C, and 8D illustrate an example of Finite Element Analysis of sealed mat system components in accordance with aspects of the subject matter disclosed herein.
Figure 8B:
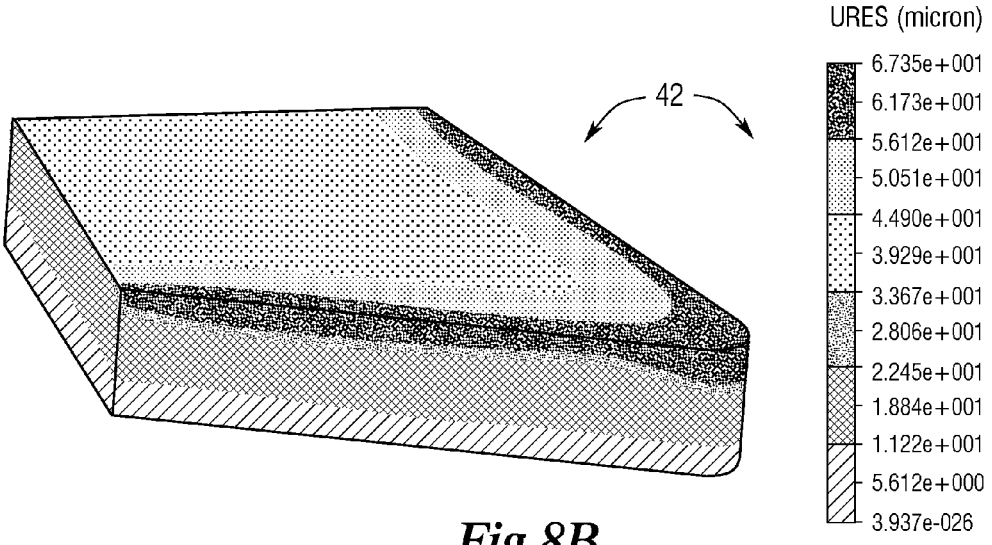
Figure 8C:
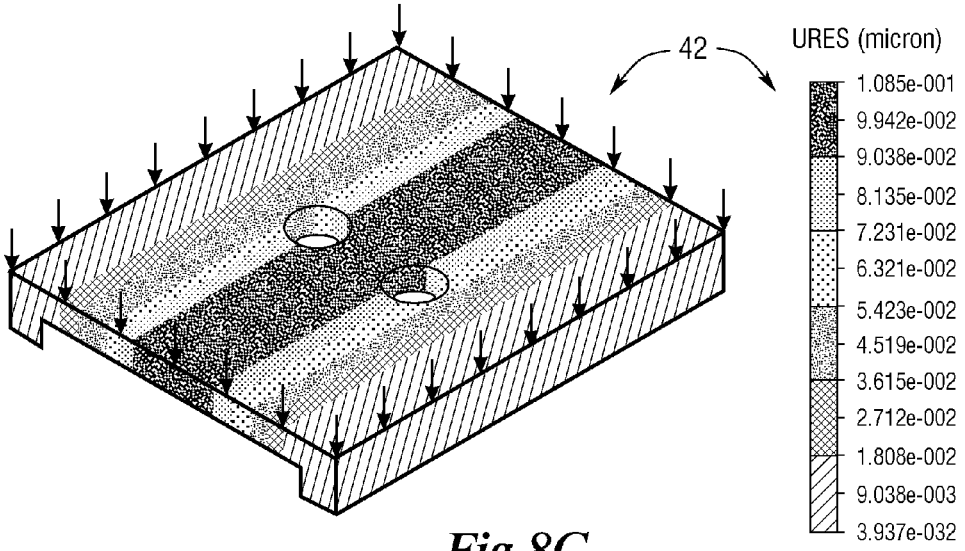
Figure 8D:
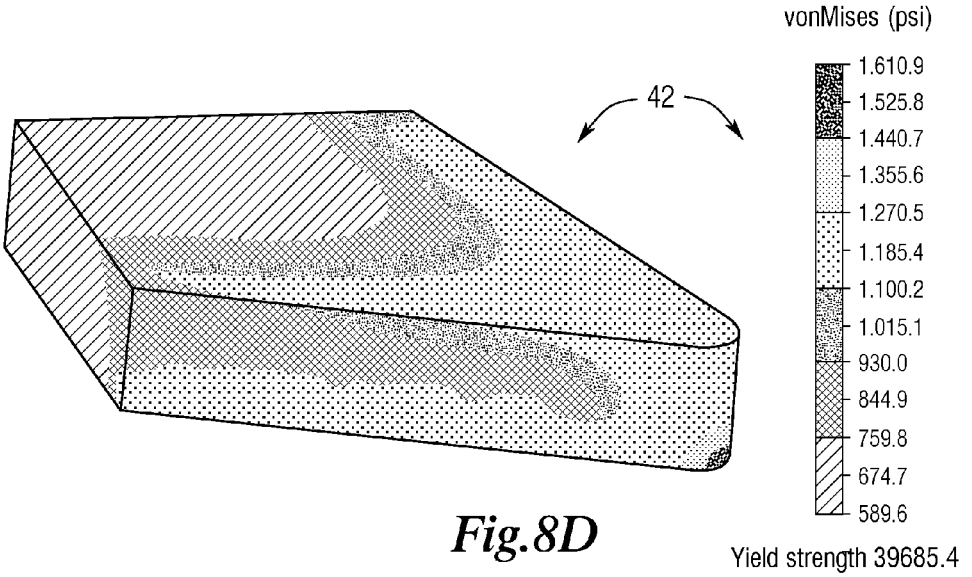

A description of the design, assembly, and testing of a sealed interconnected mat system 10, 11 is provided herein. FIGS. 1 and 7D depict a perspective view of embodiments of a sealed mat system 10, 11 that provides a stable and aseptic surface for drilling and other technical or vocational operations while protecting an environment from contamination (e.g. such as from discharge of a fluid or a solid material). The leak resistant sealed mat system 10, 11 can conform to uneven terrain surfaces while securing rainwater, dirt, sludge, spillage, wastewater, and/or waste products such as oil or other chemicals encountered during drilling, fracking, and other industrial operations. These materials can be promptly and easily removed from the sealed mat system 10, 11, thereby reducing the risk of slip and falls at a particular job site and improving personnel safety.

The sealed interconnected mat system 10, 11 can be made and deployed using the techniques described herein to secure solid and liquid waste products on the mat system, thereby preventing release of such products to an underlying surface. As illustrated in FIGS. 1 and 7D, the sealed mat system 10, 11 comprises: one or more composite panels 12 formed of a size and a shape suitable for a desired application; interlocking and interconnected channels 14; and one or more internal sealing elements 16 such as a gasket or a rubberized profile. In some embodiments, the sealed mat system 10, 11 comprises a modular design such that each composite panel 12 is separable and interchangeable with the others. This modular design enables facile assembly of the composite panels 12 into sealed mat systems 10, 11 of various sizes and complexity, as appropriate to a particular function. In a similar manner, the interlocking and interconnected channels 14 and internal sealing components 16, respectively, comprise a separable and interchangeable modular design. The preceding components form an adjustable (e.g. expandable) and unitary sealed mat system 10, 11 wherein load is distributed throughout the mat system.

In some embodiments, the sealed mat system 11 further comprises a wall or a self-contained and generally peripheral embankment 18. In some embodiments, the wall 18 optionally has a corner post 17 and, if desired, further includes one or more doors or gates 21 that open and shut (e.g. by means of a hinge or profile 19) to permit ingress and egress with respect to the sealed mat system 11.

Sandwich Composite Panels (SCP)

A building block of a sealed mat system 10, 11 is the sandwich composite panel 12 that forms the floor or the working surface of the sealed mat system. In some embodiments, a plurality of composite panels 12 can be connected or stacked to form a larger integrated sealed mat system 10, 11 having increased strength. As shown in FIGS. 2 and 3, the composite panel 12 comprises a medial or inner core 13 having a multi-cellular matrix. In some embodiments, the core 13 comprises a series of largely hollow channel spaces 23. The inner core 13 is sandwiched or positioned between at least a first and a second shell or faceplate 15, 20 to form a composite shell and core structure 12. Stated otherwise, the at least first (i.e., upper) shell 15 and at least second (i.e., lower) shell 20 are disposed about the matrix of multiple (or a plurality of) cells 13 within the composite panel 12.

Figure 2A:
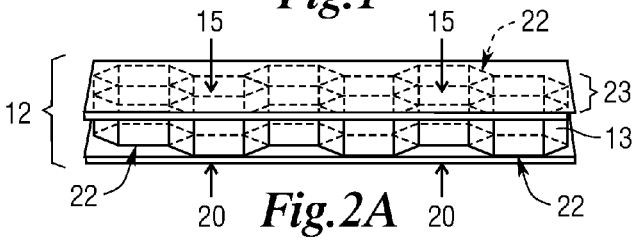
FIGS. 2A and 2B illustrate a schematic and assembly, respectively, of shell (skin) and core sandwich composite panels comprising internal cell frames in accordance with aspects of the subject matter disclosed herein.
Figure 2B:
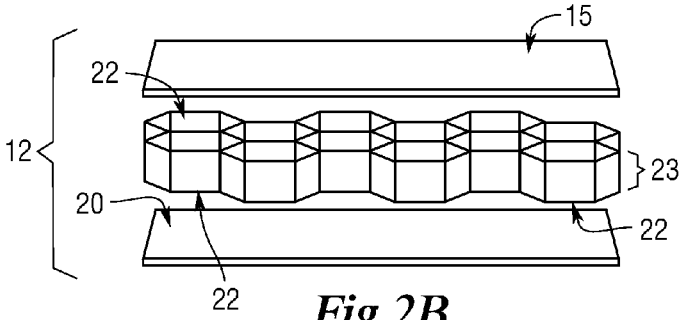
Figure 2C:
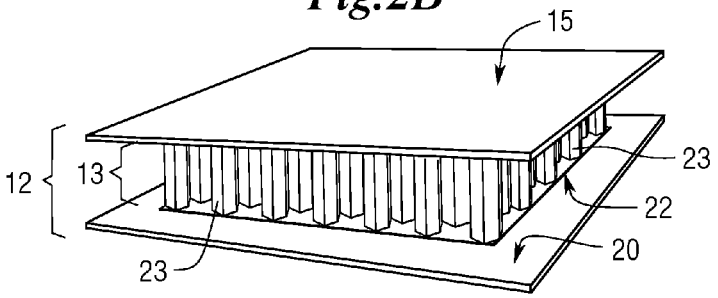
FIG. 2C illustrates a shell and core sandwich composite panel in accordance with aspects of the subject matter disclosed herein.
Figure 3A:
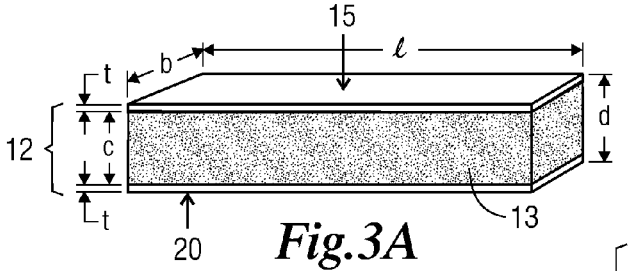
FIGS. 3A, 3B, 3C, 3D, and 3E illustrate[s] examples of composite panel designs having multiple configurations in accordance with aspects of the subject matter disclosed herein.
Figure 3B:
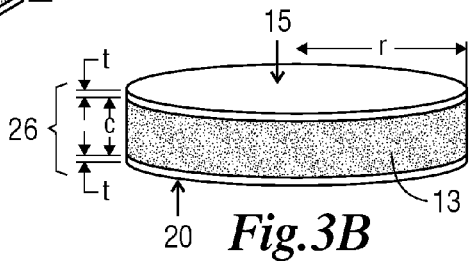
Figure 3C:
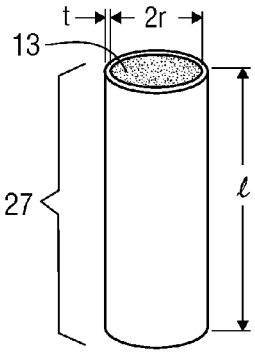
Figure 3D:
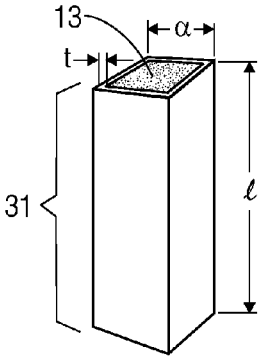
Figure 3E:
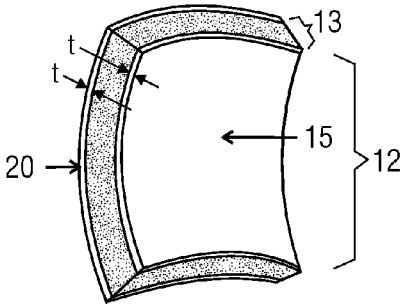

The combination shell 15, 20 and core 13 structure of the sandwich composite panel 12 provides the desirable mechanical performance for a working surface of the sealed mat system 10, 11. The first or upper shell layer 15 comprises a compression surface 15 for the sealed mat system 10, 11. The compression surface 15 bears workloads exerted by personnel, equipment, traffic, and/or other weights. This workload is supported by the sandwich composite assembly 12 and is distributed across the upper shell layer 15 while the workload is also "absorbed" through the thickness of the sandwich composite panel 12. As shown in FIGS. 2A, 2B and 2C, the second or lower shell layer 20 comprises a tension surface 20 for the sealed mat system 10, 11. In several cases, the distributed workload flexes the sandwich composite panel 12 and exerts a tension load that crosses the center plane such that the lower shell layer 20 comprises the tension surface 20. This separation of the first and second outer shells or faceplates 15, 20 by the "core" 13 interposed therein increases the moment of inertia of the sandwich composite panel 12 without a corresponding increase in the weight of the panel.

The shell-core structure of the sandwich composite panel 12 thus enables the spill containment system 10, 11 to resist bending and buckling loads. The shell layers 15, 20 are subject to tension 20 and compression 15 from pressure exerted by, for example, workload at a job site or uneven terrain. The shell layers 15, 20 impart strength to the composite panel 12. The core 13 supports the first and second shell layers so that the shells 15, 20 do not buckle and stay fixed relative to each other. The core structure 13 absorbs most of the shear stresses applied to the composite panel 12. Furthermore, the core 13 determines, to a great degree, the "stiffness" of the composite panel 12. If desired, the composition, shape, and/or density of the core 13 can be adapted to obtain a composite panel 12 having a particular stiffness or, for certain applications, pliability.

Figure 4:
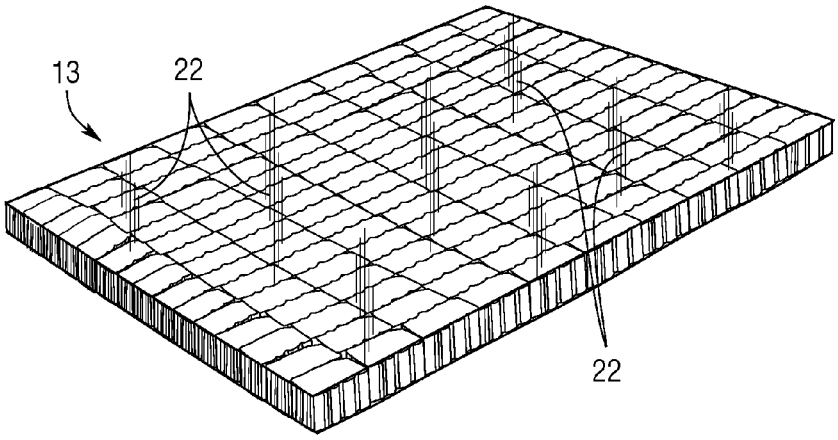
FIG. 4 illustrates a core design additionally comprising an adhesive on surfaces thereof in accordance with aspects of the subject matter disclosed herein.

The enhanced rigidity of the composite panel 12 imparts structural stability to the sealed mat system 10, 11. The composite panel 12 disclosed herein is thus well suited to applications such as heavy equipment support, where the load is prone to buckling. As shown in FIGS. 2C and 4, the composite panel structure 12 itself is leak resistant due, in part, to its sealed core structure 13. The composite panel 12 also demonstrates good fatigue properties, thermal properties, and insulation properties. The composite panel 12 comprises a fluid impervious barrier due, in part, to its sealed shell and core structures and protective inner surface.

The shell layers 15, 20 can be made of denser materials than the core 13. Such materials include, but are not limited to, metals, reinforced non-metals, glass, and ceramics. In some embodiments, the shell layers 15, 20 comprise, for example, thermoset or thermoplastic materials reinforced with continuous organic or inorganic fibers such as glass fibers, carbon fibers, basil fibers, mineral fibers, and/or shorter-discontinuous fibers such as chopped glass, carbon, and other organic or inorganic fibers. As an example, shell layers 15, 20 can comprise (long strand) fiberglass reinforced epoxy. The epoxy can further comprise carbon fibers in order to dissipate static electricity that may build up on the shells 15, 20. The carbon fibers also reinforce the epoxy. The preceding materials are available from companies such as Chang Chun Plastics Co., Ltd. (Taipei, Taiwan), PPG Industries (Pittsburgh, Pa.), Owens Corning (Toledo, Ohio), and Toray Industries, Inc. (Flower Mound, Tex. and Tokyo, Japan).

In fabrication, the shells 15, 20 can be formed, for example, by compression molding, transfer molding, machining and milling, bonding of multiple layers of sheets, extrusion, or pultrusion through a die. The shells 15, 20 can be cut from sheets to an appropriate length, width and thickness.

In some embodiments, the composite panel 12 comprises dissimilar rather than analogous, equivalent or identical shell layers 15, 20. In some embodiments (e.g. FIGS. 3B and 3C), the inner core material is flanked by shell layers 15, 20 on all sides (e.g. four) of the core 13. The stiffness of such composite panel 12 having four shell layers 15, 20 is generally higher than the stiffness of two-sided panels 12. It will be understood that any material and configuration can be employed to fabricate shell layers 15, 20 for a desired application provided that the shell layer material(s) and design aids in supporting against shear forces in the horizontal plane of the composite panel 12. In addition to the foregoing, the design of the shell layers 15, 20 depicted in FIGS. 2 and 3 enables the shells to withstand seasonal temperature variations and various forces applied to the sealed mat system 10, 11.

In some embodiments, a different thickness is employed in the top 15 and bottom 20 shells or faceplates to enhance the buckling capability of the sealed mat system 10, 11. By way of illustration, and not limitation, a shell layer of about 0.02 inch to 0.2 inch on the top surface 15, and about 0.05 inch to 0.5 inch on the bottom surface 20 meets the strength requirements of a core 13 thickness ranging from about 0.5 inch to 6 inches. The use of dissimilar (e.g. sized) top 15 and bottom 20 shells in the composite panel 12 increases the stiffness of the sealed mat system 10, 11 and contributes to the resistance of bending and buckling in the system.

The composite panel 12, when used as a cell block of the sealed mat system 10, 11, comprises shells 15, 20 and the core matrix 13. Composite panels 12 can optionally be designed to meet mechanical, thermal and chemical resistance parameters of pre-cut or preinstalled internal channels to accommodate the connecting frames 25 shown in FIG. 7. The space of these internal channels in height and in width is determined by the interlocking frame's geometry, in order to facilitate proper sealing and to accommodate thermal expansion and shrinkage. In some embodiments, interior surfaces such as the underside of the upper shell 15 and the upper side of the lower shell 20, remain smooth or rubberized to allow for proper sealing (e.g. by bonding 22) against the connecting frame 25 in one or multiple locations.

In some embodiments, the composite panel 12 additionally comprises an epoxy or other adhesive 22 that is applied to the shells 15, 20 and other surfaces adjoining or proximate to the core 13. In some embodiments, the upper 15 and lower surfaces 20 of the composite panel 12 are treated with modifiers for electric static dissipation (ESD) and ultraviolet (UV) ray blocking (modifiers added to base resin). ESD modifiers comprise, for example, short fibers or particles that can provide an electric path at a given resistivity range. Commonly used ESD conductive fillers include carbon fiber, carbon black, structural carbon, metal fibers and particles such as nickel, stainless steel, and copper. Other organic and inorganic additives may also possess reasonable electrostatic dissipative properties. Anti-slip coatings comprising abrasives, fiberglass, or other desirable layers (e.g. corrugated) or treatments can also be incorporated on surfaces of the composite panel 12 (e.g. by bonding) and sealed mat system 10, 11 to enhance workplace safety without compromising the mechanical properties of the system.

In some embodiments, the first 15 and second 20 shell layers are generally flat, attenuate, or thin (e.g. compressed or in sheet form) to minimize the weight of the shells. As shown in FIG. 3, the shell layers 15, 20 can comprise a generally curved, round, or tubular shapes rather than a substantially planar or rectilinear configuration. In general, substantially flat (and smooth) rectilinear shell layers 15, 20 form square or rectangular mat structures 10, 11 that are simpler and less expensive to manufacture, transport, and install.

It will be appreciated that other designs can be employed in fabricating the sealed mat system 10, 11 of the present teachings. By way of example, in some embodiments, composite panels 12 (e.g. comprising light weight polymer or fiberglass) can be formed by placing cylinders, thin plates, and other continuous structures between two rigid reinforced panels to provide support under heavy compressive loads.

FIGS. 2 and 3 provide examples of shell and core "composite" structures and designs. FIGS. 2A-2C depict shell and core composite structures 13 comprising a hexagonal or a honeycomb configuration. FIGS. 2A and 2B illustrate a core matrix comprising internal channel spaces. FIGS. 3A and 3E depict a rectangular and square shell and core composite, respectively, having a generally compressed (or flat) configuration. Also shown in FIG. 3, are a tubular (cylindrical) composite (3C), an elongate rectangular composite (3D), and a circular composite (3B). The tubular composite panel illustrates an example where the core can be sheathed or bordered by a single continuous shell rather than a first and a second shell. Likewise, FIG. 3D illustrates an example of a composite panel having four shell layers. Multiple shell and core configurations (e.g. pentagonal) and sizes can be adapted to suit a desired application. In some embodiments, a honeycomb core design and a core unit 23 density of, for example, about 1 mm are adopted to provide a resilient airspace that serves as a buffer in the sealed mat system 10, 11. The sample reference symbols employed in FIG. 3 are as follows: l, length; r, radius; c, core thickness; t, shell thickness; b, shell width; d, height of composite panel; and a, radius.

The core 13 of the composite panel 12 comprises a multi-unit matrix or a series of channels, apertures, or cells 23 of varying density. Likewise, varying configurations can be employed. By way of example, and not limitation, the cells 23 of the core 13 can either be open or closed structures. If desired, the core 13 can be elongated or aligned in a particular direction for a given application. In some embodiments, the core 13 comprises a solid that substantially covers at least the interior surface area of the at least first and second shell layers 15, 20. In some embodiments, the core 13 comprises a foam, polymer (e.g. polypropylene), glass, ceramic, or metal (e.g. aluminum) material.

The core 13 comprises configurations including, but not limited to, fibers (e.g. randomly attached in the form of cellular solids), bond spheres, columns, plates, shell elements, honeycomb (e.g. triangular, rectangular, square, circular, pentagonal, hexagonal, octagonal, cylindrical or tubular shapes or cell structures), and beams (e.g. rectangular and I-beams). An "I-beam" forms the simplest of such beams where the core 13 spans the length but not the width of the beam. In some embodiments, the number of I-beams in a core 13 can range from one to several I-beams. The I-beams can also be shaped in such a way that they form a triangular cross section or a corrugated shape as used in packaging.

In accordance with the present teachings, multiple core matrix 13 spacing arrangements can be employed. By way of illustration, and not limitation, core unit or cell 23 spacing can comprise a range from as small as about 0.25 inch×0.25 inch to as large as about 12 inches×12 inches. Such spacing can function, for example, as a honeycomb or a foam core, comprising an expandable and potentially infinite supporting core. If desired, a compressible material such as Styrofoam can be placed in the larger cell spaces. In some embodiments, smaller cell spaces typically remain empty.

In some embodiments, panels 12 are mounted or glued to the frame 25 (e.g. using an epoxy or other adhesive). The assembled panels serve as an auxiliary load supporting surface similar to the individual composite panel 12. Composite panel 12 assembly according to the present teachings creates an adjustable (e.g. expandable) sealed mat system 10, 11 having load distributed through all the interconnected frames 25. The panel assembly process can be used to create an expandable sealed mat system 10, 11 of potentially infinite dimensions. By reversing the process, and removing a desired number of panels, a sealed mat system 10, 11 having smaller dimensions can readily be obtained.

In some embodiments, the internal spacing used to accommodate the interconnecting frames 25 comprises a minimum size of 0.01 inch plus the size of the frame thickness vertically. In some embodiments, approximately 1.2 inches to 5.2 inches of space are used for a connecting frame 25 of about 1 inch to 4 inches in size and seals of about 0.1 inch to 0.5 inch thick. In some embodiments, the internal spacing used to accommodate the interconnecting frames 25 can be up to about 0.5 inch plus half of the width of the frame horizontally. In some embodiments, about 2.5 inches to 8.5 inches of space are used for connecting frames 25 of about 2 inches to 8 inches wide. In some embodiments, the spacing is not the same across all four sides of the spill containment system 10, 11 to allow for ease of installation using differently designed frames. That is, the length and width spacing on either side of each composite panel 12 can be designed according to a 1 to 1 ratio, a 2 to 1 ratio, a 3 to 1 ratio etc. This allows for easier installation and removal of panels 12 having certain types of interlocking frames 25.

By interposing, fusing, or bonding the core matrix 13 between a top and a bottom shell layer 15, 20, a high strength and low weight composite panel 12 is produced to form the basic support structure for the sealed mat system. A sealed mat system 10, 11 built by multiple interconnected composite panels 12 comprises an upper surface 15 on which work activities such as drilling are performed. A lower surface 20 of the sealed mat system 10, 11 can directly interface with land, water, cement or other terrain subjacent thereto without the need for a liner, collection tray or other apparatus. Each individual composite panel 12 is sealed and fluid impermeable due to the use of internal sealing components 16 in its design. As such, the upper surface 15 of the mat system, which is supported by one or more underlying sealed composite panels 12, can receive and secure any materials or fluids that spill or leak as a result of activities occurring on or above the upper surface 15 of the containment system 10, 11 or in the vicinity thereof. Materials and fluids are contained or isolated on the upper surface 15 of the mat system 10, 11 and are thus prevented from making contact with underlying and adjacent surfaces so as to avoid environmental contamination.

By way of example, and not limitation, a sealed mat structure 10, 11 having dimensions of 168 inches by 96 inches by 4 inches has an approximate volume of 32 cubic feet. The estimated density of the mat system 10, 11 is $6.5\times10^{-31}$ bs/in$^3$(11.2lbs/ft$^3$). The approximate weight of the sealed mat system can be determined by multiplying the density and volume. Thus, in this example, the weight of the sealed mat system 10, 11 is approximately 360 pounds.

In a distributed loading example involving a mat surface load of 300,000 pounds, it can be estimated that the load (i.e. weight) would be distributed over about 5,760 square inches on a sealed mat system 10, 11 comprising 40 composite panels 12. The stress on the sealed mat system 10, 11 would be approximately 52 pounds per square inch (psi). Since the yield stress of a typical liner system is approximately 8,700 psi, the sealed mat system 10, 11 would be safe for this load with a factor of safety of 167. Random point loads in the range of 10,000 pounds are typical for the sealed mat system 10, 11 disclosed herein. In this example, the sealed mat system 10, 11 would be able to withstand forces up to about 140 million pounds or 70,000 tons as measured by calculating the top cross sectional area of the sealed mat system (e.g. an area of 168×96 would be 16,128 in$^2$). The yield stress is multiplied by the area to determine the maximum force. The sealed mat system 10, 11 is rated to 4000 psi stress. A sealed mat system 10, 11 comprising composite panels 12 and having a similar geometry and load bearing capability as that described above can weigh as little as 150 pounds.

2. Interlocking Channels (IC)

The sealed interconnected mat system 10, 11 comprises multiple modular composite panels 12 as depicted, for example, in FIGS. 1-3 and 7. The composite panels 12 are interlocked together or are otherwise attached or assembled utilizing a series of internally connected locking channels 28, 30 of varying designs. With seals in place between the panel interior and the internal frame formed by the channels, the interlocking frames and panels form a leak resistant seal that secures solid and liquid materials (e.g. oil or chemical spills) in place on the sealed mat system's top surface 15. In this manner, the sealed mat system 10, 11 permits ease of clean up and disposal, preventing site and environmental contamination.

Figure 5:
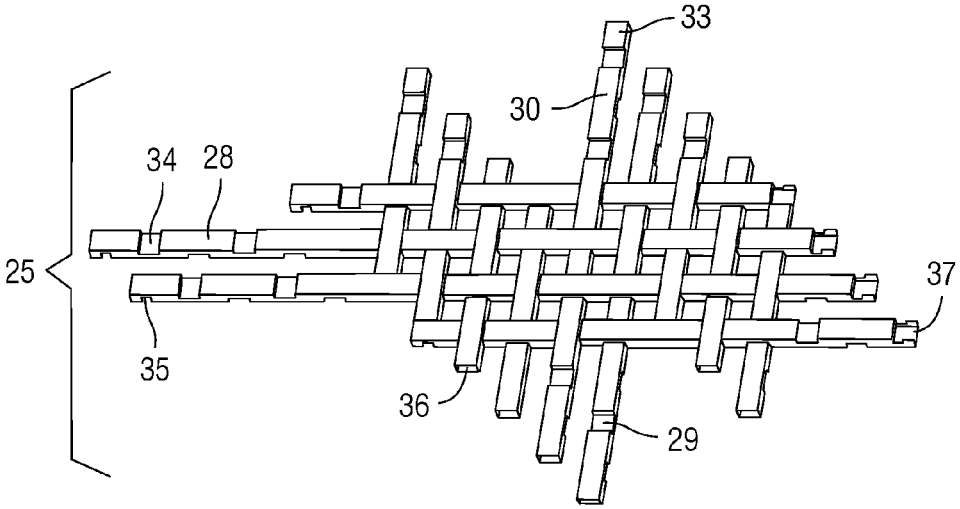
FIG. 5 illustrates an example of an interlocking and interconnected framework of transverse channels in accordance with aspects of the subject matter disclosed herein.
Figure 6A:
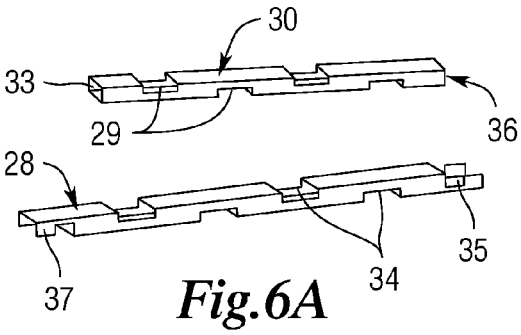
FIG. 6A illustrates a perspective view of interlocking channels in accordance with aspects of the subject matter disclosed herein.
Figure 6B:
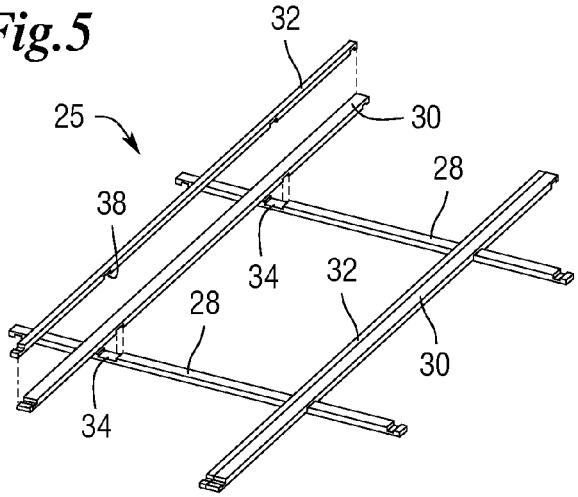
FIG. 6B illustrates a perspective view of a vertical filler channel as well as channels interlocking and interconnected together in accordance with aspects of the subject matter disclosed herein.

FIG. 5 depicts a sample framework assembly, comprising interlocking channels 14. As shown in FIG. 5, a composite panel 12 is inserted into each of the empty cell block locations. By attaching a series of finite-length horizontal 28 and vertical 30 channels or extrusion profiles, an interlocking framework 25 can be formed as both the support and restrictive element for the inserted composite panels 12, thereby forming a rigid sealed mat system 10, 11. As shown in FIGS. 5, 6A and 6B, an assembled channel framework 25 comprises, for example, a plurality of horizontal 28 and vertical 30 channels, a plurality of grooves 29 for placement of the horizontal channels, a plurality of grooves 34 for placement of the vertical channels, and a plurality of end connectors to "lock" the horizontal and vertical channels in place. By way of illustration, and not limitation, end connector A 35 is attached to a mating and corresponding end connector A prime or A' 37. Likewise, end connector B 33 mates with corresponding B prime or B' 36.

The channels 28, 30 or extrusion profiles can be connected with or without fasteners 24. FIG. 6 illustrates at least two examples of these connecting mechanisms. When the sealed mat system 10, 11 is fully assembled, the connecting mechanisms are covered and hidden inside the composite panels, as shown in FIGS. 1 and 7D.

FIG. 6A illustrates an example of horizontal 28 and vertical 30 channels having slots, grooves, spaces, or notches 29, 34 cut or located at strategic locations according to an embodiment of the present teachings. In some embodiments, the channels are sized at a convenient overall length of between about 5 feet and 30 feet. The horizontal 28 and vertical 30 channels can be interlocked and joined together by attaching the slots 29, 34 to each other, which forms the right spacing for the composite panels 12. In some embodiments, the spacing between slots 29, 34 can be designed to account for the width of the channels, the internal spacing of composite panels 12, and other factors such as the presence or absence of a spacing bar (filler channel) 32 for ease of installation (FIG. 6B). In the slotted design, the horizontal 28 and 30 vertical channels can be interlocked and assembled without any need to incorporate fasteners 24. Limited spacing between shells 15, 20 of the composite panel 12 prevents the joined channels (which create a framework 25) from separating.

In some embodiments, the preceding interlocking and securing steps are followed by placing each composite panel 12 into (or onto) a cell block space formed by the horizontal and vertical channels. In some embodiments, a horizontal or a vertical space bar 32 with a similar or a congruous slot pattern can be used for more facile installation of the sealed mat system 10, 11. FIG. 6B illustrates interconnection by way of horizontal 28 and vertical 30 channels additionally comprising a filler channel or a spacing bar 32 that includes a groove 38. As shown in FIG. 6B, the space bar allows for asymmetric internal spacing within the containment system such that there is little or no interference when the composite panel slides into the channel cell block.

Figure 6C:
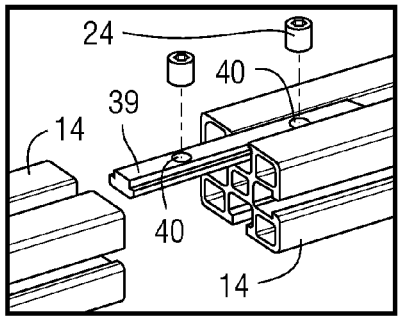
FIG. 6C illustrates an example of interlocking and interconnected channels and extrusion profiles in accordance with aspects of the subject matter disclosed herein.
Figure 6D:
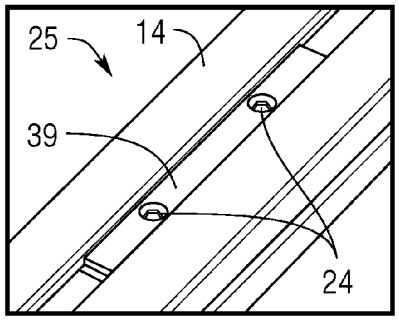
FIG. 6D illustrates a perspective view of two extrusion profiles locked together by internal fasteners in accordance with aspects of the subject matter disclosed herein.

FIGS. 6C and 6D illustrate another channel 14 connection and assembly example according to the present teachings. An extrusion profile 24 is utilized to lock adjacent profiles together with different locking mechanisms. By way of illustration, and not limitation, in this embodiment, extrusion profiles or fasteners 24 can be inserted into substantially hollow channels 14 via slots 40 formed in channel connectors 39 during assembly of the interlocking and interconnected framework 25. The channels 14 are thus locked in place such that a continuous framework 25 is formed around the composite panels 12 and the internal spaces or cell blocks within the sealed mat system 10, 11. If desired, additional surface channels can be incorporated, and a sealant (e.g. gaskets, rubberized elements, sealing bands, or weather stripping) can be installed along the channel 14 surface as well as through the internal spacing within the sealed mat system 10, 11. Other shapes that can be press-fit or molded onto the sealed mat system 10, 11 can also be employed.

The interlocking and interconnected channels or profiles can be fabricated from a variety of materials such as extruded light weight metal components (e.g. brass and aluminum), pultruded glass, reinforced epoxy composite, and extruded thermoplastics. The channels form a rigid interconnected framework (or "frame") 25. This framework 25 serves at least two functions, namely, it imparts rigidity and a sealing capability to the sealed mat system 10, 11. The leak impervious interlocking channels 14, 28, 30 provide a facile connection for the mat system 10, 11. An interlocking joint also provides a reliable seal that prevents harmful materials from leaking into the soil or ground water underlying a well site.

The load occasioned by transport vehicles is principally borne by the composite panels 12, and the framework 25 helps to distribute this load. In some embodiments, the compressive strength of the frame 25 is greater than or equal to the compressive strength of the core 13. In some embodiments, the compressive strength of the channels or profiles 14, 28, 30 exceeds that of the core 13. The channel interlocking force can also be minimal even with uneven terrain as long as the channels' connecting joint is embedded inside the composite panel 12 rather than at the edge of the panel. The bending stress experienced from the working surface is distributed and mainly absorbed by the composite panels 12 in conjunction with the shell and core design of the sealed mat system 10, 11. For certain applications, reasonable site grading requirements can be adopted so that there are no sharp protrusions of rocks or a roughness of more than one inch locally.

In practice, the framework 25 and the core 13 form an expandable supporting internal structure (e.g. FIG. 7). The expandable frame 25 and individual core 13 can form a potentially infinite larger core structure with sectional top and bottom shells 15, 20 that enable load to be dissipated throughout the sealed mat system 10, 11. Based on the internal framework formed by the interlocking channels 14, 28, 30 a sealed mat system 10, 11 can be rigidly interconnected and assembled. The assembled sealed mat system 10, 11 functions and moves as a whole (that is, as a singular unit), thereby dissipating load forces throughout the mat system and contributing to secure sealing and containment through the system. In some embodiments, the interconnected channels can be laid in a brick pattern by offsetting the channel joint locations. In such design, the connecting joint can be protected inside each of the composite panels 12, offsetting the potential for a weak fault line. These features augment the overall rigidity and reliability of the sealed mat system 10, 11 and enable less stringent requirements to be adopted in connection with ground preparation.

Although any number of composite panels 12 may be joined to form a sealed mat system 10, 11 of relatively large size, in some applications it is desirable to curtail the weight of the sealed mat system. FIG. 7 illustrates an assembled internally connected framework of channels and composite panels that create a robust and leak impervious seal throughout the sealed mat system 10, 11. As shown in FIG. 7, one or more partially filled or substantially hollow interconnected channels and interlocking frames 14, 28, 30 and panels 12 can be employed for the purpose of weight curtailment. By way of example, and not limitation, in some embodiments, each of the composite panels 12 forming the sealed mat system 10, 11 comprises a size of about 2 feet×2 feet (lower range) to about 12 feet×12 feet (upper range). In some embodiments, the composite panels 12 comprise sizes in the intermediate range of about 4 feet×6 feet to about 5 feet×10 feet. These sizes contribute to maintaining the weight of individual panels 12 below about 200 pounds per sealed mat system 10, 11 so that the system is portable. In this way, heavy machinery is not required during the assembly and disassembly phases of the sealed mat system.

In some embodiments, the geometry of the hollow interconnected channels 14 is designed to accommodate the size of composite panels 12, and to make the installation process more straightforward. For instance, as illustrated in FIG. 7, an operator can easily insert (e.g. by sliding) the panel or the frame into each other using an interlocking mechanism. In some embodiments, either the horizontal 28 or the vertical 30 channels are designed such that their lengths cover the width of one or multiple panels 12 (e.g. 5 feet to 25 feet for a 5 feet wide panel plus appropriate connecting ends). The width, thickness, and depths of the interconnecting channels 14, 28, 30 can be designed to augment the mechanical strength of the panels 12. In some embodiments, a channel thickness of about 2 inches to 4 inches is sufficient to accommodate the thickness of the core 13 minus the seals. In some embodiments, a thickness range of about 0.5 inch to 6 inches is employed.

By way of illustration, and not limitation, a channel width of about 2 inches to 8 inches provides sufficient load transfer to accommodate various physical, thermal and mechanical constraints. The width of a channel can be formed by one or multiple channels of substantially similar or the same thickness, length, and locking pattern. In some cases, using multiple channels with matching asymmetric spacing allows for easier installation of the sealed mat system 10, 11.

As shown in FIGS. 6C, 6D and 7, in some embodiments, the hollow interlocking channels or extrusion profile design 14, 28, 30 not only reduces weight but also allows for the circulation and passage of heated air through the sealed mat system 10, 11. This, in turn, keeps the surface of the sealed mat system from freezing in cold weather and mitigates the risk of slip and falls. In some embodiments, a leakage alarm system can be embedded inside the hollow channels or profiles using, for example, liquid spillage sensors with visual or audio alarms. This helps in remote monitoring of a worksite for chemical leaks. Many other functions such as surveillance or chemical sensors can be employed in conjunction with the internally connected hollow frameworks of the sealed mat system 10, 11.

Within the scope of ambient usage, the temperature variations that the sealed mat system 10, 11 experiences are in the range of about −50° F. to about 120° F. Depending on the construction material and the geometry of the composite panels 12 and the connecting frame 25, the expected dimensional changes between the panels and the frame should be within about 0.01 inch in the thickness direction (vertically) and up to about 0.5 inch in each direction length-wise (horizontally). In accordance with the present teachings, these variations are absorbed by the designed tolerance of the seals and by predetermined cavities or expansion gaps between the connecting frame 25 and the surrounding core matrix 13. In some embodiments, one or more expansion gaps can be filled with a foam-type material, sealing bands, or other compressible materials.

3. Internal Sealing Components (ISC)

Existing systems utilize linings or large overlapping layers to cover a worksite. These systems are both cost prohibitive and prone to damage due to heavy workload and potential wear and tear in use and during installation. The rigid internal framework 25 and composite panels 12 of the sealed mat system 10, 11 disclosed herein enable facile adoption of internal and external sealing mechanisms. Since the interlocking frame 25 formed by the channels 14, 28, 30 sits inside each of the composite panels 12, the interior panel surface and the exterior surface of the frame provide multiple locations for sealing and securing the mat system 10, 11. By way of illustration, and not limitation, supplementary sealing of the mat system comprises, for example, rubberizing the interior panel surfaces and/or the exterior frame surfaces, attaching sealing bands or strips to the channels or profiles, or filling the gaps with closed cell filling materials such as foam. The core 13 within the composite panels 12 further comprises an impermeable closed cell wall such that fluid is retained and confined within the interconnected channels. Fluids are also restricted through the application of multiple seals 16 to contact surfaces of the composite panel 12 and frame 25.

In regard to the multi-unit matrix (i.e., core) 13 of the composite panel 12, the multi-unit matrix serves as an additional barrier layer for imparting strength to the sealed mat system 10, 11 and for absorbing any fluids or materials that may penetrate the first (i.e., top) panel 15 of the mat system.

Fluid is thus prevented from coming into contact with the second (i.e., bottom) panel 20 and a surface underlying the sealed mat system. In use, standard materials and chemicals discharged onto the upper or work surface 15 of the sealed mat system 10, 11 are unable to traverse the first panel 15, the multi-unit matrix 13, and the second panel 20. The sealed mat system 10, 11 thus prevents materials and liquids from passing through discontinuities in the mat system to the underlying terrain or floor.

As illustrated in FIGS. 1 and 7, both the upper and lower sides of the channels 14, 28, 30 are in secure contact with the inside surfaces of the composite panels 12 so as to form a primary seal within the sealed mat system 10, 11. Stated otherwise, the primary seal is formed by secure contact and mating of the interlocking and interconnected channel framework 25 with the composite panels 12. The primary seal and the supplementary sealants 16 generally remain under compression due to the weight of the composite panels 12 and workloads on the sealed mat system's surface. In the selection of sealing elements for the mat system 10, 11, it is beneficial to utilize materials that allow a reasonable deformation in the seal under load similar to those materials utilized for the core 13.

With a sufficient sealing contact surface area, most elastomeric materials can be used as sealing elements 16. Examples of materials that are appropriate for use in the sealing elements 16 of the present teachings include, but are not limited to, sealants with a Durometer Scale Shore A hardness in the range of 50 to 100 per ASTM D 2240. By way of background, the Shore A Hardness Scale is used to determine the relative hardness of soft materials, including rubber and plastic. In general, the higher the durometer reading, the harder the material, that is, the material's resistance to permanent indentation. Sealing materials that meet the preceding specifications include, for example, rubber (e.g. natural rubber, nitrile rubber and silicone rubber), polymer foam strips, and thermoplastic elastomers. In some embodiments, thermoplastic materials softer than the panel surfaces can also be adopted. Such materials include, for example, most plastics such as polyolefins, polyurethane, polyvinylchloride, nylon, polyoxymethylene, polyacetal (POM), and any engineering plastics having a Durometer Scale Shore D hardness in the range of 20 to 90 per ASTM D 2240. The Shore D Hardness Scale measures the relative hardness of hard rubbers, semi-rigid plastics, and hard plastics.

A consideration of other suitable sealing materials can include such factors as chemical resistance to potential job site chemicals, temperature capability, geometry or contact surface areas used in design, and loading capability. In regard to chemical resistance, sealing materials 16 used in some embodiments are resistant to common inorganic or organic chemicals, including polar or non-polar solvents. In regard to temperature capability, sealing materials 16 used in some embodiments can withstand temperature variations without a drastic change in material properties. Such materials provide a durable seal regardless of shrinkage during the cold months (e.g. winter) and/or expansion during warm summer months. In some embodiments, the sealing elements 16 can accommodate temperatures in the range of about −50° F. to about 150° F. In regard to loading capability, a harder Shore D material can be selected to fill connection gaps. A harder seal generally comprises an increased loading resistance.

Multiple sealing elements 16 can be applied in between the composite panels 12 and in any spaces between the composite panels 12 and the channel framework 25. Such sealing elements 16 comprise, inter alia, internal seals that contact and adhere to the top and bottom shells 15, 20 and inside expansion joints. In some embodiments, one or more sealing elements 16 are used on the top and bottom surfaces of the internal frame compressed against the inside surfaces of the shells. The width and height of the sealing elements 16 are determined by assessing whether the elements are capable of absorbing the distributed compression load while allowing for proper thermal expansion mismatch between the channel frame 25 and the panel 12. A compressive tolerance of up to about 0.01 inch is considered to be sufficient in most embodiments for dissimilar frame and composite panel materials and construction.

In some embodiments, the channel surfaces and/or the interior surfaces of the shells 15, 20 can be further sealed by placing one or more rubber-type sealants 16 thereon. Other sealing elements 16 such as adhesive backed elastomers can be applied to the channel surfaces and/or the interior surfaces of the shells. The sealing elements 16 form protective surfaces that additionally allow for maximum load distribution. In some embodiments, additional sealing precautions can be placed inside expansion joints between the frame 25 surface and the interior core 13. Foam, gel, or other compressible and seal forming materials can be applied in those locations to further protect against any breach of seal that may result in a leakage path. The expansion joints are designed to allow for any mismatch in the coefficients of thermal expansion between dissimilar frame 25 and shell—15, 20 core 13 materials. In some embodiments, an internal expansion gap of up to about 0.5 inch is sufficient to accommodate a mismatch. In other embodiments, an internal expansion gap of up to about 1 inch is sufficient to accommodate any mismatch in the respective coefficients of thermal expansion.

In some embodiments, the sealed interconnected mat system 10, 11 comprises a single composite panel 12 or unit. In other embodiments, added reinforced polymer sheet panels are incorporated into the sealed mat system. The panels 12 of the sealed mat system 10, 11 and the interlocking and interconnected channel framework 25 provide a uniform sealed surface that can be precisely aligned for leak prevention without the need for heavy machinery such as trucks and forklifts. Some embodiments comprise the following components: a plurality of interconnected channels comprising a frame; a plurality of panels being linked by the plurality of interconnected channels; wherein each of the frames is formed about a panel and is independent of other frames such that motion in one frame does not cause motion in other frames.

In some embodiments, a rigid and expandable sealed mat system 10, 11 comprises both horizontal and vertical hollow interlocking channels 14, 28, 30. These channels form a rigid platform on which work can be performed and materials can be placed. The hollow interlocking channels 14, 28, 30 are of generally lighter weight and can be fabricated from a metallic or a non-metallic composite. As shown in FIGS. 5 and 7, the horizontal and vertical interlocking channels can be easily and uniformly aligned to form a composite sealed surface without any need for nuts, bolts or other fasteners. The interlocking surface seal eliminates the traditional leakage path through fasteners utilized in existing technologies. Moreover, the no-bolt interlocking channel mechanism substantially shortens the time required for installation. Such rapid assembly and installation time is particularly beneficial in challenging environments such as in dry or arid weather (e.g., the desert); in cold, icy or wintry weather (e.g., the Arctic); and in wet weather or marine environments (e.g., rain, swamps or oceans). In some embodiments, specially designed internal connectors can be used to extend the frame 25 and composite panel 12, allowing for a brick pattern construction.

4. Self Contained Embankment

The sealed mat system, its interconnected channels, and internal sealing elements provide a leak impermeable working surface. In some embodiments, the sealed mat system 11 comprises an optional wall or barrier 18 disposed along the perimeter or edges of the sealed mat system 11. As shown in FIG. 1, the peripheral wall 18 surrounding the sealed mat system projects upwardly from the mat system 11 and serves as a vertical barricade (or embankment) that precludes fluid and solid leakage from the sides of the mat system 11 and its working surface 15. By way of example, the wall 18 is useful in applications where containment of a significant amount of fluid (e.g. two feet of water or oil) is desired or anticipated.

In some embodiments, the wall 18 comprises approximately one-half or one-quarter of the height of the composite panel 12. By way of example, and not limitation, in some embodiments, the wall 18 comprises a height of about 0.5 feet to about 7 feet. As depicted in FIG. 1, a height of about 2 feet is suitable for most working environments and the overall dimensions of a job site. The same interlocking and interconnected frame structure 25 used to form the sealed mat system 11 can be extended to form a framework of walls that are connected to the floor components, with or without fasteners. In some embodiments, metallic or non-metallic sheets folded into a barrier shape are attached to the base or floor of the edge of the sealed mat system 11 to form the wall 18. In embodiments where fasteners are used, the fasteners can be coated with a sealant or covered with seal rings to preserve the sealing capability. Additional features can also be incorporated into or above the walls 18 such as ramps, exterior frames, overpasses for workers, job site monitoring systems, and one or more passage doors or gates 21 to allow for ingress, egress, and transportation of vehicles and equipment onto the working surface 15 of the sealed mat system 11.

In some embodiments, the sealed mat system 11 comprises strong and light weight non-metallic composite panels 12 having one or more interlocking and interconnected channels 14, 28, 30 and a seal enclosed by an optional wall 18 attached to the floor of the mat system. The floor or working surface 15 of the mat system 11 is formed by inserting a composite panel 12 into a cell block formed by interlocking horizontal 28 and vertical 30 channels as described herein. In some embodiments, the interlocked frame 25 is inserted into four sides of the composite panels 12 and then is locked together to extend the mat system 11. FIG. 4 illustrates a multi-unit matrix comprising a core structure 13 (e.g. honeycomb) forming the working surface 15 of the mat system 10 without embankment walls.

As shown in FIG. 7, during fabrication and/or installation, the composite panels 12 of the rigid sealed mat system 10, 11 are placed along a framework 25 (e.g., by sliding) to form the base or working surface of the mat system. In some embodiments, vertical panels 30 are added to the side of the mat system base 15 (e.g., by sliding or bending) to form an optional wall (e.g. 7E). As shown in FIGS. 1 and 7E, the wall 18 protrudes vertically from the floor or working surface (base) 15 of the sealed mat system 11 and prevents materials from leaking off the upper surface 15 or sides of the mat system 11. If desired, the wall 18 can be designed and customized to specifically contain a particular chemical, solid or liquid waste. The interlocking panel construction of the wall 18 permits facile slide or engage-disengage movement that allows convenient access to the sealed mat system 11 by vehicles, machinery, and the like. In some embodiments, the height of the wall 18 is on the order of about 1 inch to about 100 inches.

In some embodiments, the size of the sealed interconnected mat system 10, 11 is conveniently and inexpensively varied or customized by, for example, increasing or reducing the number of individual composite panels 12 in the mat system or adjusting, for example, the reinforced fiber composition of an interlocking composite panel. The sealed mat system 10, 11 allows for precise placement of the interlocking joint and sealing elements 16 while imparting tremendous strength sufficient to support heavy containers, equipment, and vehicles. Moreover, the generally light weight and mechanical properties of the sealed mat system 10, 11 enable ease of installation and transport without heavy machinery.

The sealed mat system 10, 11 is reusable and does not require consumables such as disposal liners. Notwithstanding its light weight, the sealed mat system 10, 11 is both strong and durable, typically lasting multiple years under normal use. Thus, over the course of its extensive useful life, the sealed mat system 10, 11 can be reused at numerous construction sites, oil fields, wells, and other locations where containment is desired. In the event of damage, the easy to assemble and disassemble sealed mat system 10, 11 allows for onsite repair, removal, or replacement of individual composite panels in the mat system. In general, it is not necessary to disassemble, move, or relocate the entire sealed mat system 10, 11 as is the case with existing liner systems. As a result, the significant solid waste generated through the use of liners is eliminated and costs are substantially reduced.

In some embodiments, interlocking joints of the sealed mat system 10, 11 are leak resistant (watertight) such that the interlocking surface seal (i.e. primary seal) eliminates the leakage path through traditional fasteners such as nuts and bolts. In some embodiments, the interlocking surface seal can additionally comprise expansion joints that accommodate thermal expansion and shrinkage in varying ambient conditions. In this way, the strength and integrity of the interlocking surface seal is maintained at temperatures ranging from about −50° F. to 150° F.

In some embodiments, the sealed mat system 10, 11, including contact surfaces and sealing elements 16, is fabricated of any rigid, durable, and corrosion resistant material. In some embodiments, materials used to fabricate the sealed mat system 10, 11 have physical properties that can withstand and protect against fluids and chemicals associated with typical spill and containment applications. Such materials include, but are not limited to, thermoplastics, thermoset polymers, and high-density polyethylene, which provides static dissipation.

Tests

Due to its durable sealing elements 16, ease of use, reusability and safety profile, a sealed interconnected mat system for spill containment 10, 11 can be conveniently and safely transported, assembled, and deployed at various locations without adverse environmental impact. In order to demonstrate the integrity of the sealed mat system 10, 11, including its ability to withstand leaks, a number of tests were performed that model real world situations for the mat system. A prototype to scale (1:10) was constructed as described herein.

During the initial stages of installing a drilling rig, the ground is leveled and graveled. In the testing environment, a fine wire mesh oriented parallel to the ground was attached to a platform and gravel was placed on top of the mesh. A prototype sealed mat system was placed on top of the gravel, and the sides of the mat system were sealed along the edges. A test stand was constructed using acrylic sheets to uphold the sealed mat system. This entire system, partially resembling an aquarium, was placed on a raised table. The sealed mat system was then caulked along its sides and edges. This ensured that any leakage that occurred would only pass through the sealed mat system rather than from the sides. Water was then added to the containment system up to a height of about two inches. The bottom of the table was observed for any leaks. A leakage alarm was placed under the sealed mat system to monitor the water path, if any.

Since there is no pressure build up in the event of a spill other than the weight of the spilled liquids or solids, an important consideration for spill prevention involves blocking potential leakage pathways. A scale model of the containment system 10, 11 was built to test for leaks by filling the containment system with water at different levels. Testing of the containment system involved checking for leaks and/or drops in pressure after attaining a constant pressure as described in ASTM E1003.

Evaluation of the mechanical work load and leakage prevention capabilities of the sealed mat system 10, 11 occurred in an additional testing environment. This larger test system comprised a sample prototype size of about 50 meters×50 meters. Using an outrigger, a load (pressure) of 168000 psi was placed on one portion of the sealed mat system to confirm that the mat system can support the weight of heavy industrial equipment and vehicles on at least one section of the mat system without collapsing. In this load bearing test, it was demonstrated that the sealed mat system 10, 11 can support such a load.

As shown in FIGS. 8A, 8B, 8C and 8D, stress testing of psi loading on the sealed mat system 10, 11 was also undertaken using Finite Element Analysis to confirm the mat system's ability to seal against fluids and to bear loads encountered at gas or oil well drill sites and other field locations. The sealed mat system 10, 11 was subjected to drastically different types of loading, including constant pressure on the upper surface 15 of the mat system as well as large loads offset to one side of the mat system. Due to the significant compressive strength of the composite panels 12 comprising the sealed mat system, the mat system 10, 11 is able to withstand a pressure of about 2000 psi (pound-force per square inch) and an offset load of about 100,000 pounds with a safety factor of approximately 3.57 and 1.35, respectively. In other tests, a specified displacement (e.g. bending) was enforced on one edge of the sealed mat system 10, 11 to determine its yield strength. FIGS. 8A-8D show the results of the Finite Element Analysis of the sealed mat system 10, 11 according to the present teachings.

Testing of the sealed mat system 10, 11 also indicates that the stress concentration may exceed the yield strength of most light weight materials at the joint position in a traditional liner system. The interlocking channel 14, 28, 30 and composite panel 12 combination minimizes the use of joints and eliminates the potential stress concentration. A large scale sealed mat system 10, 11 comprising a size of at least about 100 feet×100 feet, for example, can also be used to evaluate actual point loads encountered in the field.

As described herein, the composite panel 12 provides desirable mechanical characteristics such as compressive yield strength, compressive modulus, and strain. American Society for Testing and Materials (ASTM) Standard D792, describes methods for measuring density and specific gravity (relative density). Likewise, ASTM Standards C365 and D695 describe methods for determining compressive strength and yield. ASTM Standard D790 describes methods for measuring the flexural modulus. The parameters that determine these mechanical properties in a composite panel 12 are given below:

GEOMETRY PARAMETERS

| PARAMETERS | UPPER AND LOWER FACEPLATES | CORE MATRIX |
|---|---|---|
| Length | X | X |
| Width | X | X |
| Thickness | X | X |
| | Shape of the core cells<br>Size of the core cells | |

MATERIAL PARAMETERS

| PROPERTIES | UPPER AND LOWER FACEPLATES | CORE MATRIX (FROM WHICH CELLS ARE MADE) | CORE (E.G. AFTER FOAMING) |
|---|---|---|---|
| Density | X | X | X |
| Yield Strength | X | X | X |
| Young's Modulus | X | X | X |
| Shear Modulus | X | X | X |

In order to determine the specification values for the sealed mat system 10, 11, several components of a composite panel 12 such as the upper and lower shells or faceplates 15, 20, inner core 13, and optional epoxy or other adhesive or bonding agent 22, are tested using standard procedures such as American Society for Testing and Materials Standards D638 and D790. During testing, properties measured typically include tensile strength, tensile modulus, and flex strength.

Properties of the sealed mat system 10, 11 include, for example, the compression modulus and compressive strength of the core 13. In order to obtain representative data for the sealed mat system 10, 11, the minimum area for the test specimen is determined according to the cell size 23 of the core 13. By way of example, and not limitation, a core matrix comprising cells 23 sized and arranged in a honeycomb configuration typically requires a larger specimen than, for example, multi-unit matrices that have small cell 23 sizes. In evaluating test data of the sealed mat system 10, 11, it is also beneficial to consider whether the core 13 material was tested with or without the shells 15, 20 attached thereto.

In order to obtain high stiffness to weight ratios in some embodiments, the geometry and material properties of components of the composite panel 12 are optimized. By way of illustration, and not limitation, in applications where fluid impermeability is desired, a composite panel 12 can comprise the following sample parameters:

1. a generally light weight comprising an estimated size of 1.5×2.5×0.052 meters with apparent material density in about the 0.8 to 1.8 specific gravity range and a strong lamination structure that meets the following additional specifications (The foregoing properties can be measured in accordance with, for example, ASTM D792);
2. an ultimate compressive strength over about 5,000 psi, as measured in accordance with, for example, ASTM D695;
3. a flexural modulus over about 2 MPsi, as measured by three point bending (and/or in accordance with, for example, ASTM D790);
4. a compression yield above about 4,000 psi, as measured in accordance with, for example, ASTM D695;
5. a joint able to withstand a minimum pressure of 80 psi before seal failure, as measured in accordance with, for example, ASTM D695.

The section headings used herein are for organizational purposes only and are not to be construed as limiting the subject matter described in any way.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

What is claimed:

1. A containment system for protecting an environment from discharge of a fluid or a solid material, the system comprising:

a mat comprising an upper compression surface and a lower tension surface, said mat being capable of bearing a load placed on said upper compression surface;

a core comprising a plurality of cells, the upper compression surface and the lower tension surface being disposed about said core so as to form one or more panels;

a frame comprising a first plurality of interlocking channels adjacent to the core, the upper compression surface being disposed above said first interlocking channels and the lower tension surface being disposed below said first interlocking channels;

a second plurality of interlocking channels adjacent to the core, said second plurality of interlocking channels having spaces formed therein such that the first and second interlocking channels are connectable with one another, and a surface of at least one panel being in contact with the frame and the core, the frame being supportive of load distribution across the mat.

2. The system of claim 1, wherein said first plurality of interlocking channels comprises a plurality of internal cell frames, each internal cell frame being capable of motion under load, independently of each panel.

3. The system of claim 1, wherein said second plurality of interlocking channels further comprise slots having a spacing design that is congruous or asymmetric.

4. The system of claim 1, wherein said first plurality of interlocking channels comprises substantially hollow profiles.

5. The system of claim 1, comprising a seal formed by contact and mating of a frame formed by said first plurality of interlocking channels with the one or more panels.

6. The system of claim 1, comprising a seal formed by contact of upper and lower sides of said first plurality of interlocking channels with interior surfaces of the one or more panels.

7. The system of claim 1, further comprising:

one or more compressible sealing elements that allow for a coefficient of thermal expansion mismatch between said frame and the one or more panels.

8. The system of claim 1, further comprising one or more sealing elements that allow for deformation under load;

and said one or more sealing elements comprising a Durometer Scale Shore A hardness in the range of 50 to 100.

9. The system of claim 1, further comprising one or more sealing elements that allow for deformation under load;

and said one or more sealing elements comprising a Durometer Scale Shore D) hardness in the range of 20 to 90.

10. The system of claim 1, wherein said core comprises a multi-unit matrix having a honeycomb configuration.

11. The system of claim 1, wherein said upper compression surface or said lower tension surface comprises a substantially planar configuration.

12. The system of claim 1, wherein the one or more panels further comprise modifiers having electrostatic dissipative properties, ultraviolet ray blocking properties, anti-slip properties, or a combination thereof.

13. A mat system comprising:

a mat having an upper compression surface and a lower tension surface;

a core comprising a plurality of cells, the upper compression surface and the lower tension surface being disposed about said core so as to form one or more panels;

a frame comprising a first plurality of interlocking channels adjacent to the core, the upper compression surface being disposed above said first interlocking channels and the lower tension surface being disposed below said first interlocking channels;

a second plurality of interlocking channels adjacent to the core, said second plurality of interlocking channels having spaces formed therein such that the first and second interlocking channels are connectable with one another, and a surface of the one or more panels being in contact with the frame and the core, the frame being supportive of load distribution across the mat.

* * * * *